United States Patent [19]

Isnardi

[11] 3,996,983

[45] Dec. 14, 1976

[54] CLUB HOLDER FOR GOLF BAGS

[75] Inventor: George J. Isnardi, San Jose, Calif.

[73] Assignee: Lawrence Peska Associates, Inc., New York, N.Y. ; a part interest

[22] Filed: May 5, 1976

[21] Appl. No.: 683,636

[52] U.S. Cl. ..... 150/1.5 R; 211/60 G

[51] Int. Cl.[2] ..... A63B 55/00

[58] Field of Search ..... 150/1.5 R, 1.5 C; 211/60 G, 60 R

[56] References Cited

UNITED STATES PATENTS

| | | | |
|---|---|---|---|
| 2,508,264 | 5/1950 | Johnson | 150/1.5 R |
| 3,101,108 | 8/1963 | Ingoldt | 150/1.5 R |
| 3,172,681 | 3/1965 | Moses | 150/1.5 R X |

*Primary Examiner*—Donald F. Norton

[57] ABSTRACT

A club holder for golf bags comprising a flat plate having a plurality of apertures and an elongated opening therein, the flat plate dimensioned to be frictionally secured in the open mouth of a golf bag, a cup-like element fixedly secured on the free edges thereof under the elongated opening to the lowermost surface of the flat plate, and a cover hingedly secured to the uppermost surface of the flat plate, the cover adapted to cover the opening.

9 Claims, 3 Drawing Figures

CLUB HOLDER FOR GOLF BAGS

BACKGROUND OF THE INVENTION

1. Field of the Invention

The present invention relates to golf accessories for golf bags and clubs, and more particularly, to a club holder for golf bags.

2. Description of the Prior Art

The average golfer has a large sum of money invested in his golf clubs and endeavors to keep his clubs well protected. Pouches and elongated plastic tubes are available to protect golf clubs when placed in a golf bag and afford a limited amount of protection. Golf bag dividers and club holders have been proposed which segregate golf clubs or protective tubes for golf clubs. However, devices previously available preclude any possibility of storage in the main chamber of the golf bag aside from the storage designated for golf clubs placed therein.

U.S. Pat. No. 3,554,255 issued to J. P. Mangan on Jan. 12, 1971 discloses a golf bag adapter which is a resilient body member having a plurality of openings therein, the body member adapted to be inserted in the open end of a golf bag. U.S. Pat. No. 3,101,108 issued to R. C. Ingoldt on Aug. 20, 1963 teaches a tube retainer which is a plate of elastic material having a plurality of holes therein, the holes adapted to accept protective tubes, the plate adapted to be frictionally inserted in the mouth of a golf bag.

The present invention provides a club holder for golf bags which includes a storage area.

SUMMARY OF THE INVENTION

Therefore, it is a primary object of the present invention to provide a club holder for golf bags which segregates golf clubs preventing damage thereto.

A further object is to provide a club holder for golf bags which provides a very accessible storage area for storage of golf tees or the like.

Another object is to provide a golf club holder which may be fixedly frictionally secured within the mouth of a golf bag.

Still another object is to provide a golf club holder which securely retains golf clubs or protective tubes.

These objects, as well as further objects and advantages, of the present invention will become readily apparent after reading the description of a non-limiting illustrative embodiment and the accompanying drawing.

The present invention provides a club holder for golf bags which effectively separates golf clubs to prevent damage thereto. A flat plate having a plurality of apertures located therein is inserted into and frictionally secured in the mouth of a golf bag. Golf clubs or protective tubes are inserted into the golf bag through the apertures thereby separating the golf clubs. An elongated opening is also located in the flat plate. A cup-like element is affixed on the free edges thereof to the lowermost surface of the flat plate under the elongated opening thereby forming a storage area for golf tees or the like. A cover is hingedly secured over the elongated opening to the uppermost surface of the flat plate. The hinge hingedly securing the cover is leaf spring urged and urges the cover into an open position. A latch locks the cover in a closed position securing the contents of the storage area therein.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
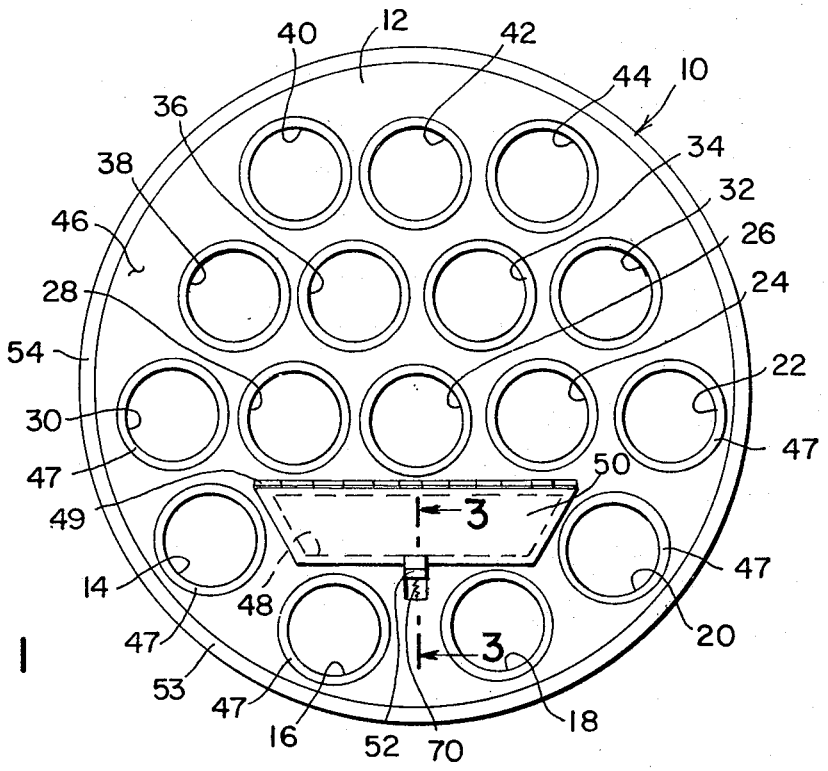
FIG. 1 is a top plan view of the preferred embodiment of the present invention.

Referring now to the figures, and more particularly to FIG. 1, there is illustrated therein a club holder 10 for golf bags including a flat plate 12. The flat plate 12 has a plurality of apertures 14, 16, 18, 20, 22, 24, 26, 28, 30, 32, 34, 36, 38, 40, 42, and 44 located therein. The longitudinal axes of the plurality of apertures are substantially perpendicular to the uppermost surface 46 of the flat plate 12. The inner edges of the plurality of apertures preferably have a resilient material 47 affixed thereon and are circular in shape. The resilient material 47 frictionally grips and protects a golf club or a protective tube placed thereagainst. The flat plate 12 also includes an elongated opening 48 therein. A cover 50 is hingedly affixed to the uppermost surface 46 of the flat plate 12 over the elongated opening 48 by a hinge 51. A latch 52 is shown and locks the cover 50 in a closed position over the elongated opening 48 as hereinafter described.

After careful consideration and experimentation the most convenient location for golf clubs placed in the club holder 10 has been found to be as follows: drivers placed in apertures 14, 16, 18, 20; No. 1 iron, No.2 iron, No.3 iron, No 4 iron, No. 5 iron, No. 6 iron, No. 7 iron, No. 8 iron, and No. 9 iron placed respectively in apertures 22, 24, 26, 28, 30, 32, 34, 36, and 38; putters placed in apertures 40, 42; and a sand wedge in aperture 44.

The flat plate 12 may be manufactured in various sizes and shapes to fit in different types of golf bags. The outer edges 53 of the flat plate 12 have a resilient material 54 affixed thereon to help create friction for retaining the plate 12 in a golf bag.

Figure 2:
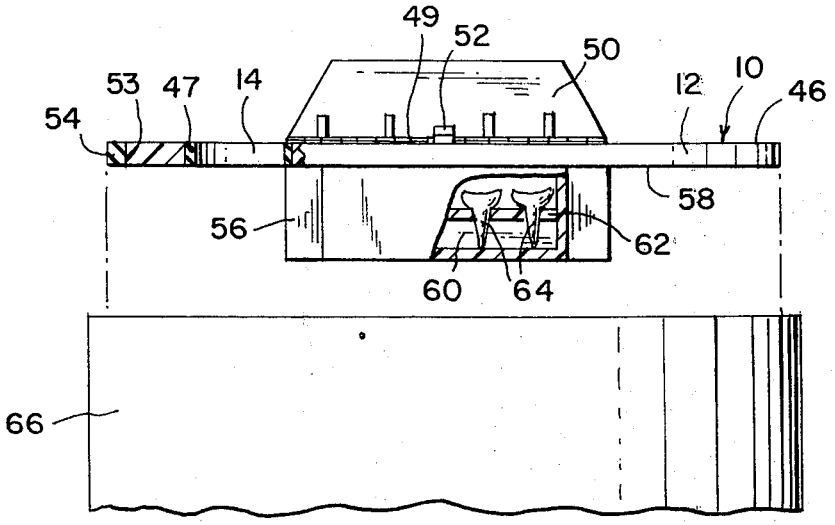
FIG. 2 is a partially broken away side view of the preferred embodiment ready to be inserted into a golf bag.

FIG. 2 illustrates a cup-like element 56 fixedly secured to the lowermost surface 58 of the flat plate 12 under the elongated opening 48 forming a storage area 60. The cover 50 is shown in an open position hingedly affixed to the uppermost surface 46 of the flat plate 12 by the hinge 49. The hinge 49 is a leaf spring urged butterfly type and urges the cover 50 to the open position. The cup-like element 56 includes a rack 62 therein which is positioned to accommodate a plurality of golf tees 64 or the like. The storage compartment is conveniently located near the driver apertures 14, 16, 18, and 20 so that a golf tee 64 may be easily and quickly obtained when needed. The plate 12 is adapted to be inserted in a golf bag 66.

Figure 3:
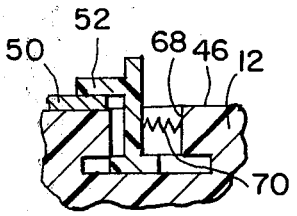
FIG. 3 is a cross sectional view of a portion of the latch taken through the lines 2—2 of FIG. 1.

FIG. 3 illustrates the latch 52 which locks the cover 50 in the closed position. The latch 52 is slideably located in a hole 68 and is urged and retained toward the cover 50 by a coil spring 70. As the latch 52 is drawn away from the cover 50, the cover 50 snaps into the open position.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A club holder for golf bags comprising:

a flat plate, said flat plate having a plurality of apertures located therein, the longitudinal axes of said apertures substantially perpendicular to the uppermost surface of said flat plate, said flat plate having an elongated opening located therein, said flat plate dimensioned to be frictionally secured in the open mouth of a golf bag, the edges of said flat plate substantially normal to the walls of said golf bag;

a cup-like element fixedly secured on the free edges thereof to the lowermost surface of said flat plate below said elongated opening forming a storage area; and a cover hingedly secured to said plate adjacent said elongated opening, said cover for selectively covering said opening.

2. The club holder as claimed in claim 1, wherein said cover is hingedly secured to said plate by a leaf spring urged butterfly hinge, said leaf spring urged butterfly hinge urging said cover pivot away from said elongated opening.

3. The club holder as claimed in claim 1, futher comprising a lock means for locking said cover substantially closing said elongated opening.

4. The club holder as claimed in claim 3, wherein said lock means comprises a spring bias means urged latch disposed in a hole located in said flat plate.

5. The club holder as claimed in claim 4, wherein said spring means comprises a helical coil spring, said spring urging said latch and locking said cover in said substantially closed position.

6. The club holder as claimed in claim 1, wherein said cup-like element further comprises a rack, said rack for accommodating a plurality of golf tees within said cup-like element.

7. The club holder as claimed in claim 1, wherein said plurality of apertures are circular in shape.

8. The club holder as claimed in claim 1, wherein said outer edges of said flat plate comprise a resilient material affixed thereon, for frictional engagement of the inner walls of said golf bag.

9. The club holder as claimed in claim 1, wherein the inner edges of said apertures have a resilient material affixed thereto for engaging golf clubs or protective tubes.

* * * * *